US011142973B2

(12) United States Patent
Ssafwany et al.

(10) Patent No.: US 11,142,973 B2
(45) Date of Patent: Oct. 12, 2021

(54) THRUST DRIVEN TRACTOR BY FLUID JETTING

(71) Applicant: Saudi Arabian Oil Company, Dhahran (SA)

(72) Inventors: Ali Radi Ssafwany, Eastern Region (SA); Samih Alsyed, Eastern Region (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/810,394

(22) Filed: Mar. 5, 2020

(65) Prior Publication Data

US 2021/0277733 A1 Sep. 9, 2021

(51) Int. Cl.

| | |
|---|---|
| ***E21B 23/00*** | (2006.01) |
| ***E21B 7/06*** | (2006.01) |
| ***E21B 34/10*** | (2006.01) |
| ***E21B 31/03*** | (2006.01) |

(52) U.S. Cl.
CPC ..... *E21B 23/00* (2013.01); *E21B 31/03* (2013.01); *E21B 34/10* (2013.01); *E21B 23/001* (2020.05); *E21B 2200/06* (2020.05)

(58) Field of Classification Search
CPC ..... E21B 23/001; E21B 7/065; E21B 41/0078
See application file for complete search history.

(56) References Cited

U.S. PATENT DOCUMENTS

| | | | | |
|---|---|---|---|---|
| 2,753,154 | A | 7/1956 | Gaut | |
| 3,273,333 | A | 9/1966 | Roulund | |
| 3,362,488 | A | 1/1968 | Rolenovich et al. | |
| 4,523,644 | A | 6/1985 | Dismukes | |
| 4,633,958 | A * | 1/1987 | Mouton | E21B 4/006 175/324 |
| 4,967,841 | A * | 11/1990 | Murray | B08B 9/0433 134/22.12 |
| 6,250,388 | B1 * | 6/2001 | Carmi | E21B 43/25 166/311 |
| 6,564,868 | B1 | 5/2003 | Ferguson et al. | |
| 9,624,743 | B2 | 4/2017 | Al Dabbous | |
| 10,113,397 | B2 | 10/2018 | Gregory et al. | |

(Continued)

FOREIGN PATENT DOCUMENTS

| | | | |
|---|---|---|---|
| GB | 2350630 | A | 12/2000 |
| GB | 2576739 | A | 3/2020 |
| WO | 2014130014 | A1 | 8/2014 |

OTHER PUBLICATIONS

International Search Report and Written Opinion of PCT Applicaqtion No. PCT/US2021/020964 dated May 26, 2021: pp. 1-11.

*Primary Examiner* — Cathleen R Hutchins
(74) *Attorney, Agent, or Firm* — Bracewell LLP; Constance G. Rhebergen; Linda L. Morgan

(57) ABSTRACT

A propulsion tool for delivering a tubing into a subterranean well for performing a downhole operation includes a tool housing, the tool housing being a tubular shaped member. A connector system is operable to secure the propulsion tool to the tubing. A jet assembly extends from an internal cavity of the tool housing to an outside of the tool housing and is oriented in an uphole direction. A jet inner flow path is located within the tool housing. The jet inner flow path is oriented to selectively direct a flow of fluid from the tubing in a direction towards the jet assembly.

13 Claims, 3 Drawing Sheets

(56) References Cited

U.S. PATENT DOCUMENTS

| | | | | |
|---|---|---|---|---|
| 2008/0217024 | A1 | 9/2008 | Moore | |
| 2015/0184468 | A1 | 7/2015 | Sherman | |
| 2015/0218900 | A1 | 8/2015 | Hallundbk et al. | |
| 2017/0159384 | A1* | 6/2017 | Romer | E21B 23/10 |
| 2019/0048689 | A1 | 2/2019 | Baudoin | |

* cited by examiner

THRUST DRIVEN TRACTOR BY FLUID JETTING

BACKGROUND

1. Field of the Disclosure

The present disclosure relates in general to the development of subterranean wells, and more particularly to delivering coiled tubing into the subterranean well for performing a downhole operation.

2. Description of the Related Art

There can be times when delivering a tubing into a wellbore of a subterranean well that the tubing can become stuck or locked up. The probability of having a tubing that becomes locked up can increase with the depth of the subterranean well and with changes of direction of the wellbore. If the tubing can no longer advance deeper into the subterranean well, the downhole operation that was meant to be performed by way of the tubing can be compromised.

In some currently available systems, a wheeled tractor or an agitator can be used to attempt to extend the tubing deeper into the subterranean well if the tubing has become locked up.

SUMMARY OF THE DISCLOSURE

Embodiments of this disclosure provide a jetting tool for providing thrust that can move a tubing through a subterranean well. Multiple jet nozzles can be fitted on an uphole end of the tool. Fluid pumped through the tubing passes through the jet nozzles for generating thrust force.

In an embodiment of this disclosure, a propulsion tool for delivering a tubing into a subterranean well for performing a downhole operation includes a tool housing, the tool housing being a tubular shaped member. A connector system is operable to secure the propulsion tool to the tubing. A jet assembly extends from an internal cavity of the tool housing to an outside of the tool housing and is oriented in an uphole direction. A jet inner flow path is located within the tool housing. The jet inner flow path is oriented to selectively direct a flow of fluid from the tubing in a direction towards the jet assembly.

In alternate embodiments, the tool housing can have a downhole end surface. The downhole end surface can be disk shaped and free of any openings through the downhole end surface. The tool housing can have an uphole end surface opposite the downhole end surface, where the jet assembly extends through the uphole end surface. The jet assembly can include a plurality of jet nozzles spaced around a circumference of an uphole end of the tool housing.

In other alternate embodiments, a treatment system can extend between the internal cavity of the tool housing to an outside of the tool housing. The propulsion tool can further include a ball seat. The ball seat can be actionable to move the treatment system from a normal closed position to an open position, defining a treatment flow path for the flow of fluid from the internal cavity of the tool housing to an outside of the tool housing through the treatment system. The ball seat can be further actionable to prevent the flow of fluid from the tubing to an outside of the tool housing through the jet assembly.

In an alternate embodiment of the disclosure, a system for delivering a tubing into a subterranean well with a propulsion tool for performing a downhole operation includes the propulsion tool secured to a downhole end of the tubing. The propulsion tool has a tool housing, the tool housing being a tubular shaped member. A jet assembly extends from an internal cavity of the tool housing to an outside of the tool housing and is oriented in an uphole direction. A jet inner flow path is located within the tool housing. The jet inner flow path selectively provides a fluid flow path from the tubing in a direction towards the jet assembly for a flow of fluids. The tubing extends from an earth's surface into a wellbore of the subterranean well, defining a tubing annulus between an outer diameter surface of the tubing and an inner diameter surface of the wellbore.

In alternate embodiments, the tool housing can have a downhole end surface. The downhole end surface can be disk shaped and free of any openings through the downhole end surface. An uphole end surface can be opposite the downhole end surface. The jet assembly can extend through the uphole end surface. The jet assembly can includes a plurality of jet nozzles spaced around a circumference of an uphole end of the tool housing. The jet nozzles can be positioned to direct the flow of fluids from the internal cavity of the tool housing into the tubing annulus.

In other alternate embodiments, a treatment system can extend between the internal cavity of the tool housing to an outside of the tool housing through a sidewall of the tool housing. The treatment system can be selectively operable to define a treatment flow path to direct the flow of fluids into the tubing annulus. The propulsion tool can further include a ball seat. The ball seat can be actionable to move the treatment system from a closed position to an open position, defining the treatment flow path for the flow of fluids into the tubing annulus through the treatment system. The ball seat can be further actionable to prevent the flow of fluids from the tubing to the tubing annulus through the jet assembly.

In another alternate embodiment of this disclosure, a method for delivering a tubing into a subterranean well with a propulsion tool for performing a downhole operation includes securing the propulsion tool to a downhole end of the tubing. The propulsion tool has a tool housing, the tool housing being a tubular shaped member. A jet assembly extends from an internal cavity of the tool housing to an outside of the tool housing and is oriented in an uphole direction. A jet inner flow path is located within the tool housing. The jet inner flow path selectively provides a fluid flow path from the tubing in a direction towards the jet assembly for a flow of fluids. The tubing extends from an earth's surface into a wellbore of the subterranean well, defining a tubing annulus between an outer diameter surface of the tubing and an inner diameter surface of the wellbore.

In alternate embodiments, the tool housing can have a downhole end surface, the downhole end surface being disk shaped and free of any openings through the downhole end surface. An uphole end surface can be opposite the downhole end surface. The jet assembly can extend through the uphole end surface. A plurality of jet nozzles can be spaced around a circumference of an uphole end of the tool housing. The method can further include directing the flow of fluids from the internal cavity of the tool housing into the tubing annulus through the plurality of jet nozzles.

In other alternate embodiments, the propulsion tool can further include a treatment system extending between the internal cavity of the tool housing to an outside of the tool housing through a sidewall of the tool housing. The method can further include directing the flow of fluids into the tubing annulus through a treatment flow path of the treatment system. The propulsion tool can further include a ball seat. The method can further include dropping a ball onto the ball seat to move the treatment system from a closed position to an open position, defining the treatment flow path for the flow of fluids into the tubing annulus through the treatment system. Drooping the ball onto the ball seat can further prevent the flow of fluids from the tubing to the tubing annulus through the jet assembly.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
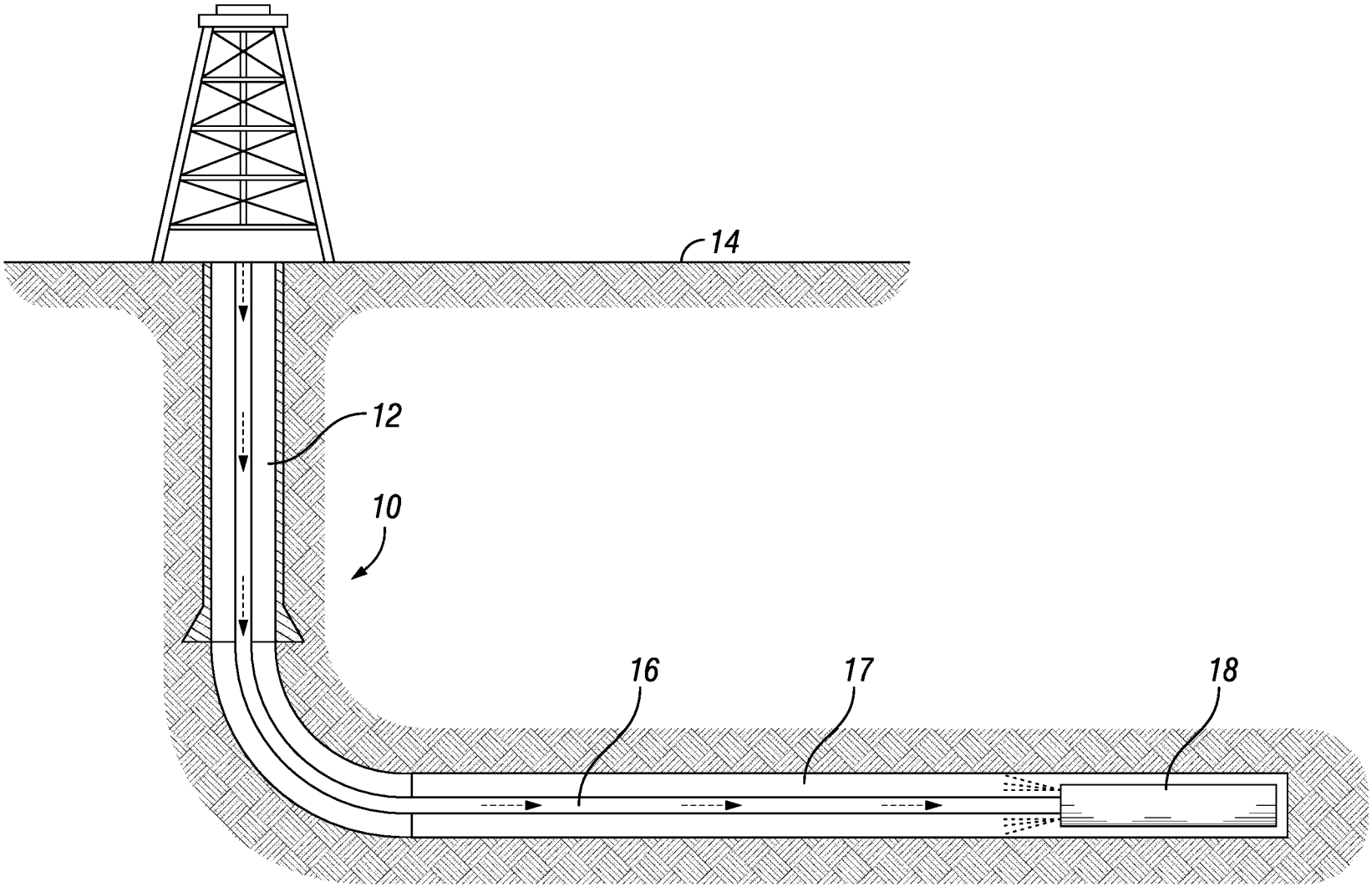
FIG. 1 is a schematic section view of a subterranean well with a propulsion tool, in accordance with an embodiment of this disclosure, shown with a flow of fluid traveling through the jet assembly.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Wellbore 12 can be drilled from surface 14 and into and through various subterranean formations.

During development or operation of subterranean well 10, there may be time when downhole operations that utilize tubing 16 are required. As an example, tubing 16 can be used to perform well interventions such as maintenance, repair, or replacement of downhole components, well reconfiguration, logging, drilling, perforating, or stimulation operations.

Tubing 16 can be, for example, a coiled tubing or other tubular member that has a central bore that can deliver fluid downhole. Tubing 16 can extend from earth's surface 15 into wellbore 12 of subterranean well 10. Tubing annulus 17 is defined between an outer diameter surface of tubing 16 and an inner diameter surface of wellbore 12.

Propulsion tool 18 can be secured to a downhole end of tubing 16. Propulsion tool 18 can be used to help to deliver tubing 16 into wellbore 12 of subterranean well 10. In particular, propulsion tool 18 can provide a thrust force that can move tubing 16 in a downhole direction if tubing 16 becomes stuck or locked up, or if tubing 16 is at risk of being stuck or locked up.

Figure 2:
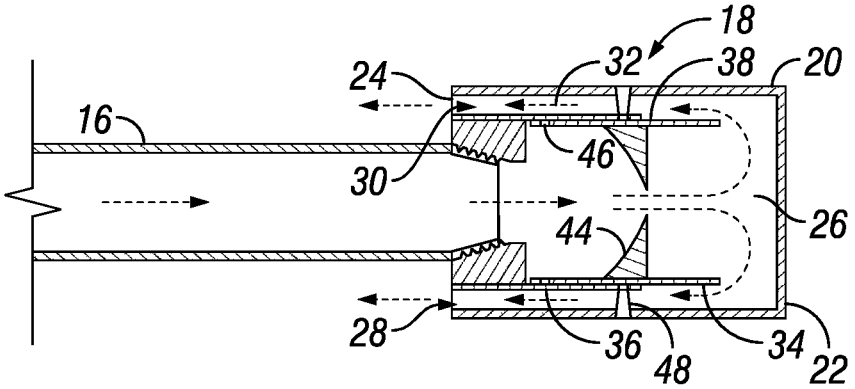
FIG. 2 is a schematic section view of propulsion tool, in accordance with an embodiment of this disclosure, shown with a flow of fluid traveling through the jet assembly.

Looking at FIG. 2, propulsion tool 18 includes tool housing 20. Tool housing 20 is a tubular shaped member. Tool housing 20 has downhole end surface 22. Downhole end surface 22 is disk shaped. Downhole end surface is 22 free of any openings through downhole end surface 22. Tool housing 20 also has uphole end surface 24 that is opposite downhole end surface 22. Uphole end surface 24 faces in a direction that is towards tubing 16. Internal cavity 26 of tool housing 20 is defined by the sidewall of the tubular body of tool housing 20, downhole end surface 22 and uphole end surface 24.

Jet assembly 28 extends through uphole end surface 24. Jet assembly 28 extends from internal cavity 26 to an outside of tool housing 20. Jet assembly 28 extends in a generally uphole direction so that fluids traveling through jet assembly 28 are directed in a generally uphole direction. However, jet assembly 28 can include aspects that are oriented in a direction radially offset from directly uphole. As an example, jet assembly 28 can include aspects that are oriented in a direction somewhat radially outward from uphole, so that the trajectory of a fluid exiting jet assembly 28 could be somewhat radially outward of directly uphole. This might be useful if a fluid jet force that pushes tubing 16 away from a sidewall of wellbore 12 would allow for tubing 16 to continue to travel downhole through wellbore 12.

Jet assembly 28 includes a plurality of jet nozzles 30 spaced around a circumference of an uphole end of tool housing 20. Jet nozzles 30 are positioned to direct the flow of fluid from internal cavity 26 of tool housing 20 into tubing annulus 17 through jet nozzles 30.

Jet inner flow path 32 is located within tool housing 20. Jet inner flow path 32 selectively provides a fluid flow path from the central bore of tubing 16, and in a direction towards jet assembly 28. In the example embodiment of FIG. 2, a flow of fluids exits a downhole end of tubing 16 and enters propulsion tool 18. The flow of fluids is directed through sleeve assembly 34 that is located within internal cavity 26 of tool housing 20. The flow of fluids exits a downhole end of sleeve assembly 34 and changes direction due to downhole end surface 22 of tool housing 20. The flow of fluids then travels in a direction uphole and is directed through jet assembly 28 into tubing annulus 17.

In the example embodiment of FIG. 2, sleeve assembly 34 is in a contracted position. In certain embodiments, sleeve assembly 34 can be biased towards the contracted position. In the contracted position, uphole sleeve 36 of sleeve assembly 34 overlaps downhole sleeve 38 of sleeve assembly 34 by a first length.

Figure 4:
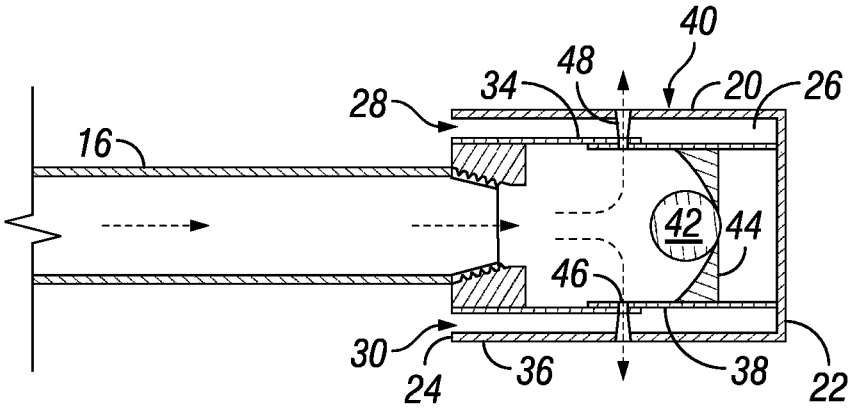
FIG. 4 is a schematic section view of propulsion tool, in accordance with an embodiment of this disclosure, shown with a flow of fluid traveling through the treatment system.
Figure 3:
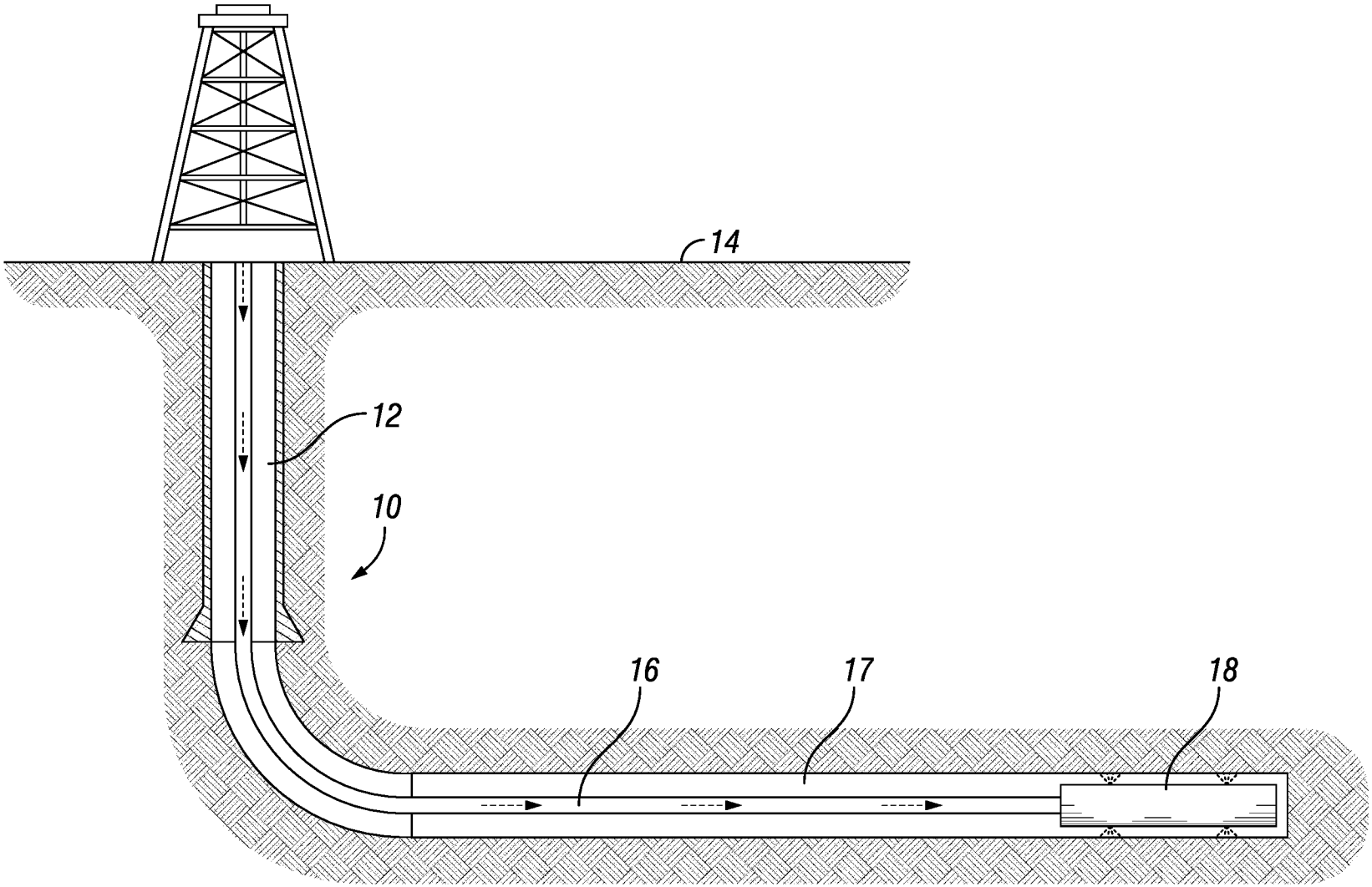
FIG. 3 is a schematic section view of a subterranean well with a propulsion tool, in accordance with an embodiment of this disclosure, shown with a flow of fluid traveling through the treatment system.

Looking at FIGS. 3 and 4, propulsion tool 18 can further include treatment system 40 extending between internal cavity 26 of tool housing 20 to an outside of tool housing 20. When a targeted formation can't be reached by currently available commercial tools, treatment system 40 of propulsion tool can be used to reach and treat the formation, such as for acid stimulation and sand clean out operations. Treatment system 40 can extend through a sidewall of tool housing 20. Treatment system 40 can be selectively operable to define a treatment flow path to direct the flow of fluids into tubing annulus 17 through treatment system 40. In the example embodiments of FIGS. 2 and 4, when treatment system 40 is directing the low of fluids into tubing annulus 17 through treatment system 40, the flow of fluids is prevented from passing through jet assembly 28.

In order to move treatment system 40 from the closed position of FIG. 2 to the open position of FIG. 4, ball 42 can be dropped onto ball seat 44. Ball seat 44 can be part of downhole sleeve 38. The weight of ball 42 and pressure buildup uphole of ball 42 can provide sufficient force to overcome the bias of sleeve assembly 34 towards the contracted position and downhole sleeve 38 can move axially relative to uphole sleeve 36 so that sleeve assembly 34 is in the extended position of FIG. 4. In the extended position, uphole sleeve 36 of sleeve assembly 34 overlaps downhole sleeve 38 of sleeve assembly 34 by a second length, where the second length of the extended position is less than the first length of the contracted position.

With ball 42 blocking the flow of fluid from exiting the downhole end of sleeve assembly 34, the flow of fluids can be redirected through sleeve port 46 and into treatment jet 48. Sleeve port 46 is a port that extends through a sidewall of downhole sleeve 38. Treatment jet 48 is part of uphole sleeve 38.

Looking at FIG. 2, when sleeve assembly 34 is in the contracted position, sleeve port 46 and treatment jet 48 are unaligned axially. By dropping ball 42 onto ball seat 44 downhole sleeve 38 is moved axially in a downhole direction relative to uphole sleeve 36, and uphole sleeve 36 remains static relative to tubing 16. Therefore, by dropping ball 42 onto ball seat 44 sleeve assembly 34 is moved from the contracted position of FIG. 2 to the extended position of FIG. 4.

Moving sleeve assembly 34 from the contracted position of FIG. 2 to the extended position of FIG. 4 causes treatment system 40 to move from the closed position of FIG. 2 to the open position of FIG. 4. Moving sleeve assembly 34 from the contracted position of FIG. 2 to the extended position of FIG. 4 also prevents the flow of fluid from tubing 16 to reach tubing annulus 17 through jet assembly 28.

Looking at FIG. 4, when sleeve assembly 34 is in the extended position, sleeve port 46 and treatment jet 48 are aligned and fluid from tubing 16 can exit a downhole end of tubing 16 and enter propulsion tool 18. The flow of fluids is directed into sleeve assembly 34 that is located within internal cavity 26 of tool housing 20. With ball 42 blocking the flow of fluid from exiting the downhole end of sleeve assembly 34, the flow of fluids is directed through sleeve port 46 and treatment jet of treatment system 40, and into tubing annulus 17 through treatment system 40. With ball 42 blocking the flow of fluid from exiting the downhole end of sleeve assembly 34, the flow of fluids is blocked from reaching or passing through jet assembly 28.

Propulsion tool 18 incudes connector system 50. Connector system 50 of the example embodiments of FIGS. 2 and 4 include threads that are located on an inner diameter surface of uphole sleeve 36. Uphole sleeve 36 and tool housing 20 are both secured to, and static relative to, tubing 16. In alternate embodiments, other connector systems common in the industry can be used to secure propulsion tool 18 to tubing 16, such as flanges, bolts, or clamps.

In an example of operation, looking at FIGS. 1-2, in order to perform a downhole operation within wellbore 12, tubing 16 can be extended into wellbore 12. Propulsion tool 18 is secured to a downhole end of tubing 16. If tubing becomes stuck or locked up, or is at increased risk of becoming stuck or locked-up, surface pumps can deliver a flow of fluid through tubing 16 at pressure. The fluid can be, for example, water or other inert fluid. In alternate embodiments, diesel or acid could be used as the fluid.

The flow of fluids pumped down through tubing 16 will be directed through jet inner flow path 32 and exit through jet assembly 28. The flow of fluid will exit through jet nozzles 30, which will at act as a flux momentum intensifier. This flux momentum shall generate sufficient propulsive thrust to exceed the friction forces causing the sticking or locking-up of tubing 16. Fluid discharge streams from jet nozzles 30 will generate a reaction thrust in the opposite direction to the flow of fluid exiting jet nozzles 30. In this way, propulsion tool 18 can push tubing 16 deeper into wellbore 12 by means of the thrust generated by jetting the flow of fluids. The size, number, and design of jet nozzles 30 will be selected to overcome the frictional forces anticipated for a particular wellbore 12 within which the downhole operation is to be performed. For example, the expected physical properties of the fluid, wellbore size and condition, and tubing properties can be used to determine appropriate nozzle selection.

After tubing 16 has been extended within wellbore 12 to a target depth, downhole operations can begin. In certain embodiments, the use of a fluid treatment can be desirable. Looking at FIGS. 3-4, in such embodiments, ball 42 can be dropped on ball seat 44. As pressure builds up behind ball 42, treatment system 40 moves from the closed position of FIG. 2 to the open position of FIG. 4. In the open position of FIG. 4, a treatment fluid can be delivered as a flow of fluids through tubing 16. The flow of fluids from tubing 16 can be directed through sleeve port 46 and treatment jet 48 of treatment system 40, and into tubing annulus 17 through treatment system 40. With ball 42 blocking the flow of fluid from exiting the downhole end of sleeve assembly 34, the flow of fluids is blocked from reaching or passing through jet assembly 28.

Therefore embodiments of this disclosure provide systems and methods for extending a tubing into a wellbore by utilizing a propulsion tool that uses fluid jetting to generate thrust. Systems and methods of this disclosure do not require wellbore wall grip, which can be required for wheeled tractors that are currently available. The thrust generated by the propulsion tool of this disclosure can help to centralize the tubing. With no hydraulic components, the propulsion tool of this disclosure is not subject to temperature limitations compared to currently available systems that utilize hydraulic components to release a stuck tubing.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A propulsion tool for delivering a tubing into a subterranean well for performing a downhole operation, the propulsion tool including:

a tool housing, the tool housing being a tubular shaped member;

a connector system operable to secure the propulsion tool to the tubing;

a jet assembly extending from an internal cavity of the tool housing to an outside of the tool housing and oriented in an uphole direction;

a sleeve assembly located within the tool housing, an outer diameter surface of the sleeve assembly and an inner diameter surface of the tool housing defining an annular shaped portion of a jet inner flow path, the jet inner flow path oriented to selectively direct a flow of fluid from the tubing in a direction towards the jet assembly;

a treatment system extending between the internal cavity of the tool housing to an outside of the tool housing; and a ball seat, the ball seat being actionable to move the treatment system from a normal closed position to an open position, defining a treatment flow path for the flow of fluid from the internal cavity of the tool housing to an outside of the tool housing through the treatment system.

2. The propulsion tool of claim 1, where the tool housing has a downhole end surface, the downhole end surface being disk shaped and free of any openings through the downhole end surface.

3. The propulsion tool of claim 2, where the tool housing has an uphole end surface opposite the downhole end surface, where the jet assembly extends through the uphole end surface.

4. The propulsion tool of claim 1, where the jet assembly includes a plurality of jet nozzles spaced around a circumference of an uphole end of the tool housing.

5. The propulsion tool of claim 1, where the ball seat is further actionable to prevent the flow of fluid from the tubing to an outside of the tool housing through the jet assembly.

6. A system for delivering a tubing into a subterranean well with a propulsion tool for performing a downhole operation, the system including:

the propulsion tool secured to a downhole end of the tubing, the propulsion tool having:

a tool housing, the tool housing being a tubular shaped member;

a jet assembly extending from an internal cavity of the tool housing to an outside of the tool housing and oriented in an uphole direction;

a jet inner flow path located within the tool housing, the jet inner flow path selectively providing a fluid flow path from the tubing in a direction towards the jet assembly for a flow of fluids;

a treatment system extending between the internal cavity of the tool housing to an outside of the tool housing through a sidewall of the tool housing, where the treatment system is selectively operable to define a treatment flow path to direct the flow of fluids into the tubing annulus; and a ball seat, the ball seat being actionable to move the treatment system from a closed position to an open position, defining the treatment flow path for the flow of fluids into the tubing annulus through the treatment system; where the tubing extends from an earth's surface into a wellbore of the subterranean well, defining a tubing annulus between an outer diameter surface of the tubing and an inner diameter surface of the wellbore.

7. The system of claim 6, where the tool housing has:

a downhole end surface, the downhole end surface being disk shaped and free of any openings through the downhole end surface; and an uphole end surface opposite the downhole end surface, where the jet assembly extends through the uphole end surface.

8. The system of claim 7, where the jet assembly includes a plurality of jet nozzles spaced around a circumference of an uphole end of the tool housing, the jet nozzles positioned to direct the flow of fluids from the internal cavity of the tool housing into the tubing annulus.

9. A method for delivering a tubing into a subterranean well with a propulsion tool for performing a downhole operation, the method including:

securing the propulsion tool to a downhole end of the tubing, the propulsion tool having:

a tool housing, the tool housing being a tubular shaped member;

a jet assembly extending from an internal cavity of the tool housing to an outside of the tool housing and oriented in an uphole direction; and a sleeve assembly located within the tool housing, an outer diameter surface of the sleeve assembly and an inner diameter surface of the tool housing defining an annular shaped portion of a jet inner flow, the jet inner flow path selectively providing a fluid flow path from the tubing in a direction towards the jet assembly for a flow of fluids; and extending the tubing from an earth's surface into a wellbore of the subterranean well, defining a tubing annulus between an outer diameter surface of the tubing and an inner diameter surface of the wellbore;

where the propulsion tool further includes a treatment system extending between the internal cavity of the tool housing to an outside of the tool housing through a sidewall of the tool housing, the method further including directing the flow of fluids into the tubing annulus through a treatment flow path of the treatment system.

10. The method of claim 9, where the tool housing has:

a downhole end surface, the downhole end surface being disk shaped and free of any openings through the downhole end surface;

an uphole end surface opposite the downhole end surface, where the jet assembly extends through the uphole end surface; and a plurality of jet nozzles spaced around a circumference of an uphole end of the tool housing; where the method further includes directing the flow of fluids from the internal cavity of the tool housing into the tubing annulus through the plurality of jet nozzles.

11. The method of claim 9, where the propulsion tool further includes a ball seat, the method further including dropping a ball onto the ball seat to move the treatment system from a closed position to an open position, defining the treatment flow path for the flow of fluids into the tubing annulus through the treatment system.

12. The method of claim 11, where drooping the ball onto the ball seat further prevents the flow of fluids from the tubing to the tubing annulus through the jet assembly.

13. A method for delivering a tubing into a subterranean well with a propulsion tool for performing a downhole operation, the method including:

securing the propulsion tool to a downhole end of the tubing, the propulsion tool having:

a tool housing, the tool housing being a tubular shaped member;

a jet assembly extending from an internal cavity of the tool housing to an outside of the tool housing and oriented in an uphole direction; and a jet inner flow path located within the tool housing, the jet inner flow path selectively providing a fluid flow path from the tubing in a direction towards the jet assembly for a flow of fluids; and extending the tubing from an earth's surface into a wellbore of the subterranean well, defining a tubing annulus between an outer diameter surface of the tubing and an inner diameter surface of the wellbore; where the propulsion tool further includes a treatment system extending between the internal cavity of the tool housing to an outside of the tool housing through a sidewall of the tool housing, the method further including directing the flow of fluids into the tubing annulus through a treatment flow path of the treatment system; and the propulsion tool further includes a ball seat, the method further including dropping a ball onto the ball seat to move the treatment system from a closed position to an open position, defining the treatment flow path for the flow of fluids into the tubing annulus through the treatment system.

* * * * *